US007651976B2

(12) United States Patent
Fukui et al.

(10) Patent No.: US 7,651,976 B2
(45) Date of Patent: Jan. 26, 2010

(54) THERMAL TRANSFER SHEET

(75) Inventors: Daisuke Fukui, Tokyo (JP); Sakie Iwaoka, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 0 days.

(21) Appl. No.: 11/718,467

(22) PCT Filed: Nov. 2, 2005

(86) PCT No.: PCT/JP2005/020229

§ 371 (c)(1),
(2), (4) Date: Mar. 19, 2008

(87) PCT Pub. No.: WO2006/049221

PCT Pub. Date: May 11, 2006

(65) Prior Publication Data

US 2008/0274310 A1 Nov. 6, 2008

(30) Foreign Application Priority Data

Nov. 2, 2004 (JP) ..... 2004-319792
Mar. 31, 2005 (JP) ..... 2005-105350
Sep. 14, 2005 (JP) ..... 2005-266362

(51) Int. Cl.
*B41M 5/035* (2006.01)
*B41M 5/50* (2006.01)

(52) U.S. Cl. ..... 503/227; 8/471

(58) Field of Classification Search ..... None
See application file for complete search history.

(56) References Cited

U.S. PATENT DOCUMENTS 4,737,486 A 4/1988 Henzel
2003/0181331 A1 9/2003 Ieshige et al.

FOREIGN PATENT DOCUMENTS

EP 1 338 433 8/2003

(Continued)

OTHER PUBLICATIONS

Extended European Search Report on EP 05805537.7, dated Jan. 24, 2008.

(Continued)

*Primary Examiner*—Bruce H Hess
(74) *Attorney, Agent, or Firm*—Connolly Bove Lodge & Hutz LLP

(57) ABSTRACT

It is an object of the present invention to provide a thermal transfer sheet which has high adhesion strength of a dye layer to a base and a high reflection density, and has a good releasing property from a image-receiving sheet in printing even after being stored in the conditions of high temperatures and high humidity, and can attain adequately satisfactory printed substances having high sharpness of thermal transfer images.

The present invention pertains to a thermal transfer sheet, wherein an under coat layer containing a thermoplastic resin and colloidal inorganic pigment ultrafine particles and a dye layer are formed in order on a face on one side of a base and a thermal transfer sheet, wherein an under coat layer formed by using colloidal inorganic pigment ultrafine particles and silicate or aluminum alcoholate and a dye layer are formed in order on a face on one side of a base.

11 Claims, 1 Drawing Sheet

FOREIGN PATENT DOCUMENTS

| | | | |
|---|---|---|---|
| JP | 59-078897 | | 5/1984 |
| JP | 60-232996 | | 11/1985 |
| JP | 63-135288 | | 6/1988 |
| JP | 05-131760 | | 5/1993 |
| JP | 05-155150 | | 6/1993 |
| JP | 08-198989 | * | 8/1996 |
| JP | 09-175046 | * | 7/1997 |
| JP | 2003-312151 | | 11/2003 |

OTHER PUBLICATIONS

Office Action in EP 08 165 229.9 dated Jul. 8, 2009.

* cited by examiner

THERMAL TRANSFER SHEET

CROSS-REFERENCE TO RELATED APPLICATIONS

This application is a National Stage of PCT/JP2005/020229 filed Nov. 2, 2005, which in turn claims priority from Japanese Applications 2004-319792 filed Nov. 2, 2004, 2005-105350 filed Mar. 31, 2005 and 2005-266362, filed Sep. 14, 2005, disclosures of which are incorporated herein by reference.

TECHNICAL FIELD

The present invention relates to a thermal transfer sheet in which an under coat layer and a dye layer are formed in order on a face on one side of a base, and specifically to a thermal transfer sheet which has high transfer sensitivity in printing, and can particularly attain prints having a high density.

BACKGROUND ART

As a method of forming images using thermal transfer, a thermal diffusion dye transfer method (sublimation dye transfer printing method) of superimposing a thermal transfer sheet in which a thermal diffusion dye (sublimation dye) as a recording material is supported on a base of a plastic film or the like on a thermal transfer image-receiving sheet in which a layer receiving the dye is provided on another base sheet of paper, a plastic film or the like to form a full color image. Since this method uses a thermal diffusion dye as a coloring material, a density and a tone can be freely adjusted on a dot by dot basis and a full color image which is faithful to a source document can be sharply displayed on the image-receiving sheet, and therefore this method is applied to the formation of color images of a digital camera, a video recorder, a computer, and the like. These images are of high quality equivalent to a silver halide photo.

However, in the formation of images by the sublimation dye transfer printing method, a problem that conventional thermal transfer sheets cannot attain sufficient print densities has arisen as a printing speed of a thermal transfer printer are becoming increasingly high.

It was also thought to increase a ratio of a dye to a resin (Dye/Binder) in a dye layer of the thermal transfer sheet for the purpose of improving print density and transfer sensitivity in printing, but if this ratio is increased, the dye is shifted to a heat resistant slipping layer on the backside of the thermal transfer sheet during winding and storing the thermal transfer sheet, and this shifted dye is kicked back to a dye layer of different colors to contaminate the layer when the thermal transfer sheet is wound off. When this contaminated layer is thermally transferred to the image-receiving sheet, there were problems that the image-receiving sheet has the hue different from a designated color or the so-called scumming is produced. Further, when high energy is applied in a thermal transfer printer at the time of thermal transfer in forming images for the purpose of improving print density and transfer sensitivity in printing, the thermal adhesion of the dye layer to the receiving layer occurs and the so-called abnormal transfer tends to occur. When a large amount of a release agent is added to the receiving layer in order to prevent the abnormal transfer, there was a problem of producing the blur/scumming of images.

In the formation of images by the sublimation dye transfer printing method, it is required that the adhesion strength of the base sheet to the dye layer in the thermal transfer sheet is high in order to prevent the so-called abnormal transfer, in which the whole dye layer is transferred to the thermal transfer image-receiving sheet.

As a thermal transfer sheet in which the print density is high and the adhesion strength of the base sheet to the dye layer is improved, a thermal transfer sheet in which an intermediate layer is provided between the base sheet and the dye layer is known.

As the thermal transfer sheet provided with the intermediate layer, there are known, for example, a thermal transfer sheet in which a hydrophilic barrier consisting of polyvinylpyrrolidone and poly vinyl alcohol/under coat layer is provided between a dye layer and a base sheet, and a thermal transfer sheet in which an intermediate layer containing a sublimation dye having a diffusion coefficient smaller than that of a sublimation dye contained in a recording layer is provided between a base film and the recording layer containing a sublimation dye (See, for example, Japanese Kokai Publication Hei5-131760 and Japanese Kokai Publication Sho60-232996). However, a printed substance having an adequately high print density cannot be obtained in any thermal transfer sheet.

In Japanese Kokai Publication Sho59-78897, a thermal transfer sheet, in which a layer formed by vapor deposition of metal or metal oxide is formed on a base and on this layer, a thin layer of dye is provided, is described. However, there was a problem that this thermal transfer sheet cannot attain a printed substance having an adequately high print density, and it requires special equipment in vapor deposition and a production cost becomes high.

In Japanese Kokai Publication 2003-312151, a thermal transfer sheet, in which a good adhesive layer containing a homopolymer of N-vinylpyrrolidone or a copolymer of N-vinylpyrrolidone and another component is provided between the base and the dye layer, is described. This good adhesive layer may be a substance formed by mixing alumina, silica and like in addition to the polymers described above, but it is not essential to contain these compounds. In the thermal transfer sheet of Japanese Kokai Publication 2003-312151, there is a problem that the efficiency of dye transfer is insufficient and in addition a releasing property in printing is low and further deteriorated when being stored in the conditions of high temperatures and high humidity.

In Japanese Kokai Publication Sho63-135288, an example, in which trialkoxysilane is applied as an under coat layer to an interface between the base and the dye layer of a thermal transfer sheet, is described, but a problem that a dye-donating element adheres to a receiving element after printing a dye on a thermal transfer image-receiving sheet and therefore the releasing property is low is pointed out. This under coat layer is unstable against water and is prone to hydrolysis since the above-mentioned silane compound has an alkoxide group, and has a problem of deteriorating a dye in the dye layer. Furthermore, in Japanese Kokai Publication Sho63-135288, there is no description on mixing with other oxides.

In Japanese Kokai Publication Hei5-155150, an under coat layer formed by reacting a polymer having an inorganic primary chain comprising oxide of Group IVb metal with a copolymer such as acryloxyalkoxysilane is described. The under coat layer in Japanese Kokai Publication Hei5-155150 has a problem that it is low in heat resistance since it is an organic chain derived from the above copolymer and that it is prone to hydrolysis and unstable since it has the above inorganic primary chain. In addition, with respect to silicate, in Japanese Kokai Publication Hei5-155150, silicon is only presented as of a Group IVb metal, and there is no further specific description and no description on mixing of silicate with other oxides.

Japanese Kokai Publication Hei5-131760
Japanese Kokai Publication Sho60-232996
Japanese Kokai Publication Sho59-78897
Japanese Kokai Publication 2003-312151
Japanese Kokai Publication Sho63-135288
Japanese Kokai Publication Hei5-155150

DISCLOSURE OF THE INVENTION

In view of the above-mentioned state of the art, it is an object of the present invention to provide a thermal transfer sheet which has high adhesion strength of a dye layer to a base and a high reflection density, and has a good releasing property from a image-receiving sheet in printing even after being stored in the conditions of high temperatures and high humidity, and can attain adequately satisfactory printed substances having high sharpness of thermal transfer images.

Means for Solving the Problems

The present invention pertains to a thermal transfer sheet (hereinafter, this thermal transfer sheet may be also referred to as a "thermal transfer sheet (1)"), wherein an under coat layer containing a thermoplastic resin and colloidal inorganic pigment ultrafine particles and a dye layer are formed in order on a face on one side of a base.

The present invention pertains to a thermal transfer sheet, wherein an under coat layer formed by using colloidal inorganic pigment ultrafine particles and silicate or aluminum alcoholate and a dye layer are formed in order on a face on one side of a base.

Of the thermal transfer sheet of the present invention, a thermal transfer sheet, in which the under coat layer is formed by using colloidal inorganic pigment ultrafine particles and silicate, may be referred to as a "thermal transfer sheet (2)", and a thermal transfer sheet, in which the under coat layer is formed by using colloidal inorganic pigment ultrafine particles and aluminum alcoholate, may be referred to as a "thermal transfer sheet (3)".

In the present specification, the above-mentioned thermal transfer sheets (1), (2), and (3) may be collectively called "a thermal transfer sheet of the present invention".

Hereinafter, the present invention will be described in detail.

1. Thermal Transfer Sheet (1)

The best embodiment that is the thermal transfer sheet (1) of the present invention is shown in FIG. 1. The thermal transfer sheet (1) in FIG. 1 has a constitution in which a heat resistant slipping layer 4 to enhance a slipping property of a thermal head and prevent sticking is provided on a face or one side of a base 1, and the under coat layer 2 comprising a thermoplastic resin and colloidal inorganic pigment ultrafine particles and the dye layer 3 are formed in order on a face on the other side of the base 1.

Hereinafter, each layer constituting the thermal transfer sheet (1) of the present invention will be described in detail.

(Base)

The above-mentioned base is not particularly limited, but a base comprising a resin having such a level of heat resistance and strength that a base is not deteriorated in performing thermal transfer is preferred.

Examples of the above-mentioned resin composing the base include polyethylene terephthalate, 1,4-polycyclohexylene dimethylene terephthalate, polyethylene naphthalate, polyphenylene sulfide, polystyrene, polypropylene, polysulfone, polyamide(aramide), polycarbonate, polyvinyl alcohol, cellophane, cellulose derivatives such as cellulose acetate, polyethylene, polyvinyl chloride, nylon, polyimide, ionomer, and the like. As the above resin, polyethylene terephthalate is preferred.

The above resin may be composed of only one kind of the above resins or may be composed of two or more kinds of the above resins.

A thickness of the above base is generally about 0.5 to 50 μm, and preferably about 1 to 10 μm.

In the above-mentioned base, an adhesion treatment is often applied to the face on which the under coat layer containing a thermoplastic resin and colloidal inorganic pigment ultrafine particles and the dye layer are formed. A plastic film of the above-mentioned base is preferably subjected to an adhesion treatment because when the under coat layer is formed on the plastic film, the adhesion between the base and the under coat layer tends to be insufficient.

As the adhesion treatment, publicly known modification technologies of a resin surface such as a corona discharge treatment, a flame treatment, an ozone treatment, an ultraviolet treatment, a radiation treatment, a surface roughening treatment, a chemical agent treatment, a plasma treatment, a low temperature plasma treatment, a primer treatment and a grafting treatment can be applied as-is. Further, these treatments may be applied alone or in combination of two or more kinds.

The above-mentioned primer treatment can be performed, for example, by applying a primer solution to an unstretched film in forming a film by the melt extrusion of a plastic film and then stretching the film.

In the present invention, among the above-mentioned adhesion treatments, a corona discharge treatment and a plasma treatment are preferred in that general-purpose treatment methods can be used without increasing the cost and the adhesion of the base to the under coat layer can be enhanced.

(Under Coat Layer)

The under coat layer 2 in the thermal transfer sheet (1) of the present invention is provided between the base and the dye layer and contains a thermoplastic resin and colloidal inorganic pigment ultrafine particles.

A publicly known compound can be used as the above-mentioned colloidal inorganic pigment ultrafine particles, and examples of the above-mentioned colloidal inorganic pigment ultrafine particles include silica (colloidal silica), alumina or alumina hydrate (alumina sol, colloidal alumina, cationic aluminum oxide or hydrate thereof, pseudo-boehmite), aluminum silicate, magnesium silicate, magnesium carbonate, magnesium oxide, titanium oxide and the like.

In the under coat layer of the thermal transfer sheet (1) of the present invention, particularly, colloidal silica or alumina sol is preferably used.

In the above-mentioned under coat layer, as the colloidal inorganic pigment ultrafine particle, only one kind of material may be used, or two or more kinds of materials such as a combination of colloidal silica and alumina sol may be used.

Particle sizes of the above-mentioned colloidal inorganic pigment ultrafine particles are 100 nm or smaller in terms of an average particle diameter, preferably 50 nm or smaller, and particularly preferably 3 to 30 nm. It is possible to improve the adhesion between the base and the dye layer and prevent the abnormal transfer in the thermal transfer sheet by having an average particle diameter of the above colloidal inorganic pigment ultrafine particles within the range described above.

The colloidal inorganic pigment ultrafine particles in the present invention may take on any shape, for example, sphere form, acicular form, plate form, feather form, infinite form and the like.

Further, colloidal inorganic pigment ultrafine particles, which are treated by bringing them into an acid type, into cations in terms of charge, or surface treated for being easily dispersed in a water base solvent in sol form, can be used.

In the thermal transfer sheet (1) of the present invention, as a thermoplastic resin used in, for example, the under coat layer, hydrophilic resins can be used.

Examples of the above-mentioned hydrophilic resin include polyester resins, polyacrylic acid ester resins, polyurethane resins, styrene acrylate resins, cellulose resins such as ethylcellulose, hydroxyethylcellulose, ethylhydroxy cellulose, hydroxypropylcellulose, methylcellulose, cellulose acetate and cellulose butyrate, polyvinyl acetal resins such as polyvinyl acetoacetal and polyvinyl butyral, polyvinylpyrrolidone resin, and polyvinyl alcohol resins.

The above-mentioned thermoplastic resins in the under coat layer may be used alone or as a mixture of two or more kinds.

As the above-mentioned thermoplastic resins in the under coat layer, particularly a polyvinylpyrrolidone resin or a polyvinyl alcohol resin is preferred in that the adhesion between a base and a dye layer is good and a dying property of a dye is low.

Examples of the above-mentioned polyvinylpyrrolidone resin in the under coat layer include single polymers (homopolymers) of vinylpyrrolidone such as N-vinyl-2-pyrrolidone, N-vinyl-4-pyrrolidone and the like, or copolymers thereof.

As the above-mentioned polyvinylpyrrolidone resin, a polyvinylpyrrolidone resin having a K value in a Fickencher's formula of 60 or more is preferably used and particularly a polyvinylpyrrolidone resin of a K-60 to K-120 grade can be used, and these polyvinylpyrrolidone resins have a number average molecular weight of the order of 30000 to 280000. When a polyvinylpyrrolidone resin having a K value of less than 60 is used, an effect of improving the transfer sensitivity in printing becomes small.

As the above-mentioned polyvinyl alcohol resin in the under coat layer, compounds having a saponification degree of 50 to 100 mol % and a polymerization degree of 200 to 3500 are preferred.

When the above-mentioned saponification degree and polymerization degree are too low, the adhesion to the base or the dye layer tends to decrease, and when they are too high, viscosity becomes too high and therefore the suitability for coating may be deteriorated.

The above-mentioned thermoplastic resin in the under coat layer preferably has a glass transition temperature Tg of 60° C. or more.

When a Tg of the above-mentioned thermoplastic resin falls within the above range, it becomes possible to further prevent the occurrences of thermal adhesion of a dye layer to a material on which the dye is transferred, and abnormal transfer due to thermal damages to an under coat layer resulting from heat from a thermal head, or the occurrences of printing unevenness of a material on which the dye is transferred due to wrinkles of a thermal transfer sheet produced in thermal transfer recording.

When a Tg of the thermoplastic resin is less than 60° C. in the above-mentioned under coat layer, by heat in printing, the thermoplastic resin becomes apt to be fluidized and abnormal transfer tends to occur, and a dye contained in the dye layer is diffused back into the under coat layer and transfer sensitivity tends to be reduced.

A mixing ratio by weight between the colloidal inorganic pigment ultrafine particles and the thermoplastic resin in the above-mentioned under coat layer is preferably 1/4 to 1/0.1, and more preferably 1/4 to 1/0.5.

When the proportion of the colloidal inorganic pigment ultrafine particles mixed in the under coat layer is too high, a releasing property from a image-receiving sheet in printing tends to deteriorate after the thermal transfer sheet is left standing and stored in the conditions of high temperatures and high humidity. On the other hand, when the proportion of the thermoplastic resin mixed in the under coat layer is too high, a releasing property from a image-receiving sheet in printing tends to deteriorate and the adhesion to a dye layer may be deteriorated after the thermal transfer sheet is left standing and stored in the conditions of high temperatures and high humidity.

When the under coat layer is coated, it is preferred to provide fluidity for a coating solution for the under coat layer by adjusting the viscosity of the coating solution for the under coat layer to be low in consideration of the suitability for coating.

The under coat layer in the thermal transfer sheet (1) of the present invention has a structure containing the above-mentioned thermoplastic resin and colloidal inorganic pigment ultrafine particles, and it can be formed by applying a coating solution formed by dispersing inorganic pigment ultrafine particles in sol form and dispersing or dissolving a thermoplastic resin in a water base solvent by publicly known means for forming a layer such as a gravure coating method, a roller coating method, a screen printing method, a reverse roll coating which uses a gravure plate and the like, and drying the coating solution.

The water base solvent in the above-mentioned coating solution is not particularly limited and includes, for example, water; mixtures of water and alcohols such as ethanol, propanol and the like. Further, as the above water base solvent, mixtures of water and organic solvents, for example, cellosolves such as methyl cellosolve, ethyl cellosolve and the like; aromatic solvents such as toluene, xylene, chlorobenzene and the like; ketones such as acetone, methyl ethyl ketone and the like; ester solvents such as ethyl acetate, butyl acetate and the like; ethers such as tetrahydrofuran, dioxane and the like; chlorine solvents such as chloroform, trichloroethylene and the like; nitrogen-containing solvents such as dimethylformamide, N-methylpyrrolidone and the like; dimethyl sulfoxide; and the like can also be used, but water, or the mixture of water and alcohols is preferred.

The under coat layer in the thermal transfer sheet (1) of the present invention has an amount of coating of about 0.02 to 1 $g/m^2$, preferably about 0.03 to 0.1 $g/m^2$ as a dried amount of application.

The above under coat layer is formed by applying the above-mentioned coating solution on the base, and drying the coating solution with hot air to remove water so that the colloidal inorganic pigment ultrafine particles in sol form become gel form and cause the thermoplastic resin to fix the inorganic pigment ultrafine particles as a binder. Accordingly, the above under coat layer is not subjected to a baking treatment based on a common sol-gel method.

In the under coat layer in the thermal transfer sheet (1) of the present invention, it is preferred that a thermoplastic resin and colloidal inorganic pigment ultrafine particles are principal components and other components are not present or remains a little as a solvent. The under coat layer thus containing a thermoplastic resin and colloidal inorganic pigment ultrafine particles is formed as a coat between the base and the dye layer, and it can enhance the adhesion between the base and the dye layer and prevent the abnormal transfer of the dye layer to the thermal transfer image-receiving sheet when the under coat layer is heated in combination with the thermal transfer image-receiving sheet to perform the thermal transfer.

Further, since the under coat layer is composed of a thermoplastic resin and colloidal inorganic pigment ultrafine particles which a dye from the dye layer hardly dyes, it prevents the dye from transferring from the dye layer to the under coat layer in printing and performs effectively the dye diffusion to the receiving layer side of the image-receiving sheet, and thereby the under coat layer has the high transfer sensitivity in printing and can enhance a print density. Further, the under coat layer prevents the tendency that a releasing property from a image-receiving sheet in printing is deteriorated after being stored in the conditions of high temperatures and high humidity compared with the case where the under coat layer is composed of only the colloidal inorganic pigment ultrafine particles.

(Dye Layer)

The thermal transfer sheet (1) of the present invention has a constitution in which the dye layer 3 is provided across the above-mentioned under coat layer on a face on one side of a base.

This dye layer can be composed of a single layer of one color or can be constructed by repeatedly forming a plurality of the dye layers including dyes having different hues sequentially on the same face of the same base. The dye layer is a layer in which a thermally transferable dye is supported by an arbitrary binder.

As the dyes to be used, any dye, which is a dye fused, dispersed, or sublimated and transferred by heat and is used in publicly known thermal transfer sheets of sublimation dye transfer, can be used in the present invention, but the dyes to be used can be selected in consideration of a hue, printing sensitivity, light resistance, a shelf life, solubility in a binder and the like.

The above-mentioned dye is not particularly limited and example of the dye include diaryl methane dyes; triaryl methane dyes; thiazole dyes; merocyanine dyes; methyne dyes such as pyrazolone methyne; indoaniline dye; azomethine dyes such as acetophenoneazomethine, pyrazoloazomethine, imidazoleazomethine, imidazoazomethine, and pyridoneazomethine; xanthene dyes; oxazine dyes; cyanostyrene dyes such as dicyanostyrene and tricyanostyrene; thiazine dyes; azine dyes; acridine dyes; benzeneazo dye; azo dyes such as pyridoneazo, thiopheneazo, isothiazoleazo, pyrroleazo, pyrraleazo, imidazoleazo, thiadiazoleazo, triazoleazo and dizazo; spiropyran dyes; indolinospiropyran dyes; fluoran dyes; rhodaminelactam dyes; naphthoquinone dyes; anthraquinone dyes; and quinophthalone dyes.

A binder in the above-mentioned dye layer is not particularly limited and publicly known resin binders can be used.

As the above-mentioned resin binder, cellulose resins such as methylcellulose, ethylcellulose, hydroxyethylcellulose, ethylhydroxy ethylcellulose, hydroxypropylcellulose, cellulose acetate and cellulose butyrate; vinyl resins such as polyvinyl alcohol, polyvinyl acetate, polyvinyl butyral, polyvinyl acetal, polyvinylpyrrolidone and polyacrylamide; polyester resins; phenoxy resin; and the like are preferred.

As the above-mentioned resin binder, resins having high adhesion are more preferred because they can maintain the adhesion of the under coat layer to the dye layer even after leaving them in the conditions of high temperatures and high humidity.

Examples of the above-mentioned resins having high adhesion include resins having a hydroxyl group, carboxyl group and the like such as polyvinyl butyral, polyvinyl acetal, polyvinyl acetate, polyester resins, and cellulose resins.

Examples of the resin binders in the above-mentioned dye layer further include a releasable grafted copolymer. The above-mentioned releasable grafted copolymer can also be compounded together with the above-mentioned resin binders as a release agent.

The above-mentioned releasable grafted copolymer is formed by graft-polymerizing at least one kind of a releasable segment selected from a polysiloxane segment, a carbon fluoride segment, hydrocarbon fluoride segments and long chain alkyl segments to a polymer principal chain constituting the resin binders described above.

As the above-mentioned releasable grafted copolymer, among others, a grafted copolymer obtained by grafting the polysiloxane segment to a principal chain consisting of polyvinyl acetal is preferred.

The above-mentioned dye layer may be formed by mixing a silane coupling agent in the dye layer in addition to the above-mentioned dye and the above-mentioned binder.

When the silane coupling agent is mixed in the above dye layer, it is thought that a silanol group produced by hydrolysis of the silane coupling agent is condensed with a hydroxyl group of an inorganic compound existing at the surface of the under coat layer, and thereby the adhesion of the dye layer to the under coat layer will be improved. Further, when the silane coupling agent has an epoxy group, an amino group or the like, the silane coupling agent reacts with a hydroxyl group, a carboxyl group or the like of a resin binder to chemically bond to these groups, and thereby the strength of the dye layer itself is enhanced and the break of the dye layer due to flocculation daring thermal transfer can be prevented.

Examples of the above-mentioned silane coupling agent include isocyanate group-containing compounds such as γ-isocyanatepropyltrimethoxysilane and γ- isocyanatepropyltriethoxysilane; amino group-containing compounds such as γ-aminopropyltrimethoxysilane, γ-aminopropyltriethoxysilane, N-β-aminoethyl-γ-aminopropyltriethoxysilane and γ-phenylaminopropyltrimethoxysilane; and epoxy group-containing compounds such as γ-glycidoxypropyltrimethoxysilane and β-(3,4-epoxycyclohexyl)ethyltrimethoxysilane.

In the above-mentioned dye layer, the above-mentioned silane coupling agents may be mixed alone or in combination of two or more kinds.

The above-mentioned dye layer may be formed by mixing various publicly known additives in the dye layer in addition to the above dyes and the above binders, and the silane coupling agents to be added as desired.

Examples of the above-mentioned additives include polyethylene waxes to be added for improving a releasing property against a thermal transfer image-receiving sheet or coating suitability of ink, organic particles, and inorganic particles.

The above-mentioned dye layer can be generally formed by adding the above dye and the above binder, and the additives as required to a proper solvent, and appropriately dissolving or dispersing the respective components in the solvent to prepare a coating solution, and then applying the resulting coating solution onto the under coat layer and drying it.

As an application method of the above-mentioned coating solution, publicly known means such as a gravure printing method, a screen printing method and a reverse roll coating which uses a gravure plate can be employed, but among others, gravure printing method is preferred.

The dye layer thus formed has an amount of coating of 0.2 to 6 g/m$^2$, preferably about 0.3 to 3 g/m$^2$ as a dried amount of application.

(Heat Resistant Slipping Layer)

The thermal transfer sheet (1) of the present invention may be a substance in which a heat resistant slipping layer 4 is provided on a face of the backside of the side of the base on which the under coat layer is provided in order to prevent deleterious effects such as sticking, print wrinkles and the like due to heat from a thermal head.

A resin forming the above-mentioned heat resistant slipping layer may be publicly known resins, and examples of such resins include a polyvinyl butyral resin, a polyvinyl acetoacetal resin, a polyester resin, a vinyl chloride-vinyl acetate copolymer, a polyether resin, a polybutadiene resin, a styrene-butadiene copolymer, polyols (polyalcohol polymer compound etc.), acrylpolyol, polyurethane acrylate, polyester acrylate, polyether acrylate, epoxyacrylate, a prepolymer of urethane or epoxy, a nitrocellulose resin, a cellulose nitrate resin, a cellulose acetate propionate resin, a cellulose acetate butyrate resin, a cellulose acetate hydrogen phthalate resin, a cellulose acetate resin, an aromatic polyamide resin, a polyimide resin, a polyamideimide resin, a polycarbonate resin, and a chlorinated polyolefin resin.

The above-mentioned heat resistant slipping layer is generally formed by mixing an agent for a slipping property in addition to the above heat resistant resins in order to enhance a slipping property of a thermal head.

Examples of the above-mentioned agent for a slipping property include phosphate ester, metallic soap, silicone oil, graphite powder, a fluorine graft polymer, and silicone polymers such as a silicone graft polymer, an acrylsilicone graft polymer, acrylsiloxane and arylsiloxane.

In the above-mentioned heat resistant slipping layer, the above-mentioned agents for a slipping property may be mixed alone or in combination of two or more kinds.

The above-mentioned heat resistant slipping layer may be overcoated with the above-mentioned agent for a slipping property in place of being mixed with the above-mentioned agent for a slipping property.

The above-mentioned heat resistant slipping layer may be a substance formed by mixing additives such as a crosslinking agent, a release agent and a filler (organic powder, inorganic powder) in addition to the heat resistant resins and the above agents for a slipping property, which are added as desired.

For example, when a crosslinking agent such as a polyisocyanate is mixed in the above heat resistant slipping layer, heat resistance, a coating property and adhesion can be improved. Further, when a release agent, and organic powder or inorganic powder is mixed in the above heat resistant slipping layer, a traveling property of a thermal head can be improved. Examples of the above-mentioned release agent include waxes, higher fatty acid amides, esters, and surfactants. Examples of the above-mentioned organic powder include fluororesins. Examples of the above-mentioned inorganic powder include silica, clay, talc, mica and calcium carbonate.

As the above heat resistant slipping layer, a layer comprising polyol, for example a polyalcohol polymer compound, a polyisocyanate compound and a phosphate compound is preferred, and further a layer formed by adding a filler to these components is more preferred.

The heat resistant slipping layer can be formed by dissolving or dispersing the resins, the agents for a slipping property to be added as required and fillers described above in a proper solvent to prepare a coating solution for a heat resistant slipping layer, and applying the resulting coating solution on a base sheet by means for forming a layer such as a gravure printing method, a screen printing method, a reverse roll coating method which uses a gravure plate and the like, and drying the coating solution. As the above-mentioned means for forming a layer, among others, the gravure printing method is preferred.

An amount of coating of the above heat resistant slipping layer is preferably 0.1 to 3 g/m$^2$ on a solid content basis, and more preferably 1.5 g/m$^2$ or less.

2. Thermal Transfer Sheet (2)

The thermal transfer sheet (2) of the present invention is formed by laminating the under coat layer and the dye layer in order on a face on one side of a base.

The base in the above-mentioned thermal transfer sheet (2) is not particularly limited, but a base comprising a resin having such a level of heat resistance and strength that a base is not deteriorated in performing thermal transfer is preferred.

Examples of the above-mentioned resin composing the base include substances exemplified on the thermal transfer sheet (1) described above. As the above resin, polyethylene terephthalate is preferred.

The above base may be composed of only one kind of the above resins or may be composed of two or more kinds of the above resins.

A thickness of the above base is generally about 0.5 to 50 μm, and preferably about 1 to 10 μm.

The thermal transfer sheet (2) of the present invention is superior in the adhesion of a base to an under coat layer since the under coat layer is formed by using colloidal inorganic pigment ultrafine particles and silicate, but it is preferred to apply an adhesion treatment to the face of the side of the base on which the under coat layer and the dye layer are formed in order to further improve the adhesion.

As the above-mentioned adhesion treatment, publicly known modification technologies of a resin surface such as technologies exemplified on the thermal transfer sheet (1) described above can be applied. The above-mentioned adhesion treatments may be applied alone or in combination of two or more kinds.

As the adhesion treatment in the thermal transfer sheet (2) of the present invention, a corona discharge treatment and a plasma treatment are preferred in that the adhesion of the base to the under coat layer can be enhanced without increasing the cost.

The under coat layer in the thermal transfer sheet (2) of the present invention is formed by using colloidal inorganic pigment ultrafine particles and silicate.

An average particle diameter and shapes of the colloidal inorganic pigment ultrafine particles in the above-mentioned thermal transfer sheet (2) are similar to those of the thermal transfer sheet (1) described above.

The colloidal inorganic pigment ultrafine particle in the above-mentioned thermal transfer sheet (2) is not particularly limited as long as it can react by condensation with silicate described later.

Examples of the above-mentioned colloidal inorganic pigment ultrafine particles include alumina or alumina hydrate (alumina sol, colloidal alumina, cationic aluminum oxide or hydrate thereof, pseudo-boehmite), aluminum silicate, magnesium silicate, magnesium carbonate, magnesium oxide, titanium oxide and the like. Among others, alumina sol is preferably used from the viewpoint of improving the adhesion to the base.

The above-mentioned colloidal inorganic pigment ultrafine particle may be substances being subjected to various treatments as with the thermal transfer sheet (1) described above.

The under coat layer in the above-mentioned thermal transfer sheet (2) may be a substance formed by using only one kind of material as the above colloidal inorganic pigment ultrafine particle or a substance formed by using two or more kinds of materials as the above colloidal inorganic pigment ultrafine particle.

In the thermal transfer sheet (2) of the present invention, silicate is mixed in order that colloidal inorganic pigment ultrafine particles are crosslinked with one another to enhance a film formation property and mechanical strength of the under coat layer, and thereby a releasing property at the time of printing is improved and further adhesion strength of a dye layer to a base is enhanced.

As the above-mentioned crosslinked structure, a structure is conceivable, which is formed by producing a —Si—O-M-bond by condensation reaction of a —Si—OR group (in a formula, R represents an alkyl group having a carbon number of 1 to 10) or a —Si—OH group in the above-mentioned silicate with a -M-OH group (in a formula, M is an atom composing the colloidal inorganic pigment ultrafine particle and an atom other than oxygen and hydrogen) in the colloidal inorganic pigment ultrafine particles in forming the under coat layer described later.

The under coat layer in the above-mentioned thermal transfer sheet (2) may be a layer formed by mixing only one kind of the above silicates or a layer formed by mixing two or more kinds of the above silicates.

Hitherto, with respect to the thermal transfer sheet, there was a problem that a releasing property from a image-receiving sheet is deteriorated in printing after the thermal transfer sheet is stored in the conditions of high temperatures and high humidity in the case where only the colloidal inorganic pigment ultrafine particles is mixed in the under coat layer.

On the other hand, when the colloidal inorganic pigment ultrafine particles and a thermoplastic resin such as polyvinylpyrrolidone, polyvinyl alcohol or the like are mixed in the under coat layer, the resulting thermal transfer sheet has a good releasing property from the image-receiving sheet even in printing after being stored in the conditions of high temperatures and high humidity.

The thermal transfer sheet (2) of the present invention can further improve the adhesion strength of a dye layer to a base, that is, the thermal transfer sheet (2) of the present invention has the good releasing property from the image-receiving sheet and the high adhesion strength of a dye layer to a base even after being stored in the conditions of high temperatures and high humidity since as described above, the crosslinked structure can be formed by forming an under coat layer using not only colloidal inorganic pigment ultrafine particles but also silicate.

Examples of the above-mentioned silicate include silicate compounds expressed by the following formula:

[Formula 1]

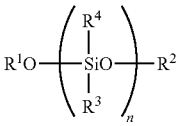

wherein $R^1$ and $R^2$ are the same or different and each represents an alkyl group having a carbon number of 1 to 10, $R^3$ and $R^4$ may be the same or different and each represents an alkyl group having a carbon number of 1 to 10, an alkoxy group having a carbon number of 1 to 10, a vinyl group, a (meth) acryloyl group, an epoxy group, an amide group, a sulfonyl group, a hydroxyl group, or a carboxyl group, and n is an integer of 1 to 50.

Examples of alkoxide of silicon of the above-mentioned silicate compounds include tetramethoxysilane.

Examples of an oligomer having a siloxane skeleton of the above-mentioned silicate compounds include reactive ultrafine silica described in WO 95/17349. The above-mentioned oligomer is not particularly limited and it can be obtained by hydrolysis condensation of the above silicon alkoxide.

As the above-mentioned silicate, silicon alkoxide, or an oligomer having a siloxane skeleton which is obtained by hydrolysis condensation of the above silicon alkoxide is preferable.

An amount of the silicate used for forming the under coat layer is preferably 0.1 to 50 parts by weight with respect to 100 parts by weight of the colloidal inorganic pigment ultrafine particle, and more preferably 5 to 35 parts by weight.

When the proportion of silicate to be mixed is too low in forming the under coat layer, effects, based on mixing of silicate described above, such as an improvement in a film formation property and the like cannot be sometimes attained. On the other hand, when the proportion of silicate to be mixed is too high in forming the under coat layer, the gelation of a coating solution for the under coat layer, the reduction in a reflection density, and the reduction in the adhesion strength of the under coat layer to a dye layer after being stored in the conditions of high temperatures and high humidity may occur.

The thermal transfer sheet (2) of the present invention has a constitution in which a dye layer is provided on the under coat layer described above, formed on a face on one side of a base. The dye layer in the above-mentioned thermal transfer sheet (2) can be provided in the same way as in the thermal transfer sheet (1) described above.

The above-mentioned thermal transfer sheet (2) may be formed by further providing a heat resistant slipping layer as with the thermal transfer sheet (1) described above.

The thermal transfer sheet (2) of the present invention cab be prepared, for example, by forming the under coat layer and the dye layer in order on a face on one side of a base using a coating solution for an under coat layer and a coating solution for a dye layer, but among others, it is preferred to prepare this thermal transfer sheet by (1) applying a coating solution for a heat resistant slipping layer onto a face on one side of a base and drying the coating solution to form a heat resistant slipping layer, and (2) forming the under coat layer and the dye layer in order on a face of the backside of the side of the base on which the heat resistant slipping layer is provided using a coating solution for an under coat layer and a coating solution for a dye layer.

The above-mentioned heat resistant slipping layer and dye layer can be provided in the same way as in the thermal transfer sheet (1) described above.

The above-mentioned coating solution for an under coat layer comprises the above-mentioned silicate and the above-mentioned colloidal inorganic pigment ultrafine particles and it is formed by dissolving or dispersing silicate and colloidal inorganic pigment ultrafine particles in sol form in a solvent or a dispersion medium.

In the above-mentioned coating solution for an under coat layer, an amount of the above colloidal inorganic pigment ultrafine particles is not particularly limited, but it is preferably 0.1 to 50% by weight for achieving a desired effect.

The above-mentioned silicate may be contained in an amount of the above-mentioned range with respect to the above colloidal inorganic pigment ultrafine particle in the above-mentioned coating solution for an under coat layer.

A solvent or dispersion medium in the above-mentioned coating solution for an under coat layer is not particularly limited and includes, for example, the medium comprising only alcohols described above in addition to substances exemplified on the thermal transfer sheet (1) described above.

A pH of the coating solution for an under coat layer is not particularly limited.

The coating solution for an under coat layer can be prepared by publicly known methods, and for example, it can be prepared by mixing a solution containing silicate in a dispersion in sol form, containing the above colloidal inorganic pigment ultrafine particles.

The coating solution for an under coat layer in the thermal transfer sheet (2) of the present invention can be applied by the same method as in the thermal transfer sheet (1) described above. This coating solution for an under coat layer may be applied in such a way that a dried amount of application is preferably about 0.02 to 1 $g/m^2$, and more preferably about 0.03 to 0.3 $g/m^2$.

The under coat layer can be formed by applying the coating solution for an under coat layer, and then drying the coating solution with hot air to remove water so that the colloidal inorganic pigment ultrafine particles in sol form become gel form, and crosslinking silicate with inorganic pigment ultrafine particles to fix them on the base.

3. Thermal Transfer Sheet (3)

The thermal transfer sheet (3) of the present invention is formed by laminating the under coat layer and the dye layer in order on a face on one side of a base.

The base in the above-mentioned thermal transfer sheet (3) is not particularly limited and can be provided in the same way as in the thermal transfer sheet (1) described above.

The under coat layer in the thermal transfer sheet (3) of the present invention is formed by using colloidal inorganic pigment ultrafine particles and aluminum alcoholate.

An average particle diameter and shapes of the above colloidal inorganic pigment ultrafine particles are similar to those of the thermal transfer sheet (1) described above.

The above-mentioned colloidal inorganic pigment ultrafine particle is not particularly limited as long as it can react by condensation with aluminum alcoholate described later, and examples of this ultrafine particle include substances exemplified on the thermal transfer sheet (1) described above.

The above-mentioned colloidal inorganic pigment ultrafine particle may be substances being subjected to various treatments as described above.

The under coat layer in the above-mentioned thermal transfer sheet (3) may be a substance formed by using only one kind of material as the above colloidal inorganic pigment ultrafine particle or a substance formed by using two or more kinds of materials as the above colloidal inorganic pigment ultrafine particle.

The above-mentioned aluminum alcoholate in the thermal transfer sheet (3) is mixed in order that colloidal inorganic pigment ultrafine particles are crosslinked with one another to enhance a film formation property and mechanical strength of the under coat layer, and thereby a releasing property at the time of printing is improved and further adhesion strength of a dye layer to a base is enhanced.

As the above-mentioned crosslinked structure, for example, (1) a structure is conceivable, which is formed by producing a —Al—O-M- bond by condensation reaction of a —Al—OR group (in a formula, R represents an alkyl group having a carbon number of 1 to 10) in the above-mentioned aluminum alcoholate with a -M-OH group (in a formula, M is an atom composing the colloidal inorganic pigment ultrafine particle and an atom other than oxygen and hydrogen) in the colloidal inorganic pigment ultrafine particles before completing the formation of the under coat layer described later.

Further, in addition to the formation of the above crosslinked structure, (2) a crosslinked structure between aluminum alcoholates formed by a series of reactions in which a —Al—O—Al— bond is formed by dehydration condensation between —Al—OH groups produced by hydrolysis of an alkoxyl group of the above-mentioned aluminum alcoholate, (3) a hydrogen bond between the above —Al—OH groups, and (4) a hydrogen bond between a —Al—OH group produced by hydrolysis of an alkoxyl group of the above-mentioned aluminum alcoholate and a polar group in the surface of the base are produced, and thereby it is thought that the above-mentioned releasing property and adhesion strength are further improved.

The hydrolysis, the condensation reaction and the formation of hydrogen bond in the above paragraphs (1), (2), and (3) may be initiated during preparing the coating solution for an under coat layer.

Hitherto, with respect to the thermal transfer sheet, there was a problem that a releasing property from a image-receiving sheet is deteriorated in printing after the thermal transfer sheet is stored in the conditions of high temperatures and high humidity in the case where only the colloidal inorganic pigment ultrafine particles is mixed in the under coat layer.

On the other hand, when the colloidal inorganic pigment ultrafine particles and a thermoplastic resin such as polyvinylpyrrolidone, polyvinyl alcohol or the like are mixed in the under coat layer, the resulting thermal transfer sheet has a good releasing property from the image-receiving sheet even in printing after being stored in the conditions of high temperatures and high humidity.

The thermal transfer sheet (3) of the present invention can further improve the adhesion strength of a dye layer to a base, that is, the thermal transfer sheet (3) of the present invention has the good releasing property from the image-receiving sheet and the high adhesion strength of a dye layer to a base even after being stored in the conditions of high temperatures and high humidity since as described above, the crosslinked structure can be formed by forming an under coat layer using not only colloidal inorganic pigment ultrafine particles but also aluminum alcoholate.

The above-mentioned aluminum alcoholate generally means compounds expressed by the following formula:

[Formula 2]

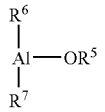

wherein $R^5$ represents an alkyl group having a carbon number of 1 to 10, $R^6$ and $R^7$ are the same or different and each represents an alkyl group having a carbon number of 1 to 10, an alkoxyl group having a carbon number of 1 to 10, a phenyl group, or a phenoxy group, and the above-mentioned alkyl group and the above-mentioned alkoxyl group may be a straight chain or a branched chain when the respective groups have a carbon number of 3 or more.

[Formula 3]

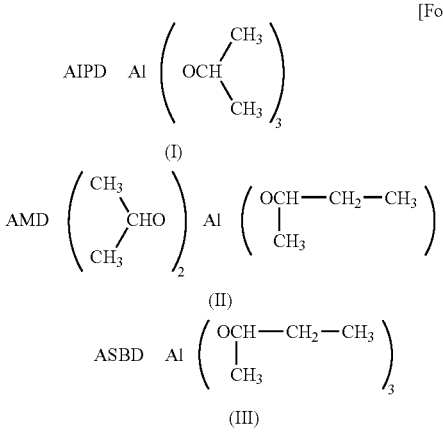

The above-mentioned aluminum alcoholate may be various commercial products such as products produced by Kawaken Fine Chemicals Co., Ltd.

The under coat layer in the above-mentioned thermal transfer sheet (3) may be a substance formed by mixing only one kind of material as the above-mentioned aluminum alcoholate or a substance formed by mixing two or more kinds of materials as the above-mentioned aluminum alcoholate.

An amount of the above aluminum alcoholate used for forming the under coat layer in the above-mentioned thermal transfer sheet (3) is preferably 0.1 to 50 parts by weight with respect to 100 parts by weight of the total of the colloidal inorganic pigment ultrafine particle and the above aluminum alcoholate, and more preferably 1 to 10 parts by weight in that the thermal transfer sheet has a high adhesion strength of a dye layer to a base even after being stored in the conditions of high temperatures and high humidity.

When the proportion of aluminum alcoholate to be mixed is too low in forming the under coat layer, effects, based on mixing of aluminum alcoholate described above, such as an improvement in a film formation property and the like cannot be sometimes attained. On the other hand, when the proportion of aluminum alcoholate to be mixed is too high in forming the under coat layer, the gelation of a coating solution for the under coat layer, the reduction in a reflection density, and the reduction in the adhesion strength between the base and the dye layer after being stored in the conditions of high temperatures and high humidity may occur.

The thermal transfer sheet (3) of the present invention has a constitution in which a dye layer is provided on the under coat layer described above, formed on a face on one side of a base.

The above-mentioned thermal transfer sheet (3) may be formed by further providing a heat resistant slipping layer on a face of the backside of the side of the base on which the under coat layer described above is formed.

The dye layer and the heat resistant slipping layer in the above-mentioned thermal transfer sheet (3) can be provided in the same constitution as in the thermal transfer sheet (1) described above.

The thermal transfer sheet (3) of the present invention can be generally prepared by the same procedure as in the thermal transfer sheet (2) described above except for mixing aluminum alcoholate in an amount within the range described above in place of silicate in the coating solution for an under coat layer.

Effect of the Invention

Since the thermal transfer sheet of the present invention has the above-mentioned constitution, it prevents the dye from transferring from the dye layer to the under coat layer in printing and performs the dye diffusion to the receiving layer side of the image-receiving sheet effectively, and thereby transfer sensitivity in printing is high and a print density can be enhanced. Further, in the thermal transfer sheet of the present invention, a releasing property from a image-receiving sheet in printing after being stored in the conditions of high temperatures and high humidity is hardly deteriorated compared with the case where the under coat layer is composed of only the colloidal inorganic pigment ultrafine particles. Particularly, the thermal transfer sheets (2) and (3) of the present invention have high adhesion strength of a dye layer to a base even after being stored in the conditions of high temperatures and high humidity.

BEST MODE FOR CARRYING OUT THE INVENTION

Hereinafter, the present invention will be described in more detail by way of examples and comparative examples, but the present invention is not limited to these examples and comparative examples.

In addition, "part(s)" or "%" refers to "part(s) by weight" or "% by weight" in Examples, unless otherwise specified.

EXAMPLE 1

A coating solution 1 for an under coat layer, having the following composition, was applied onto a polyethylene terephthalate (PET) film having a thickness of 4.5 μm as a base in such a way that a dried amount of application was 0.06 $g/m^2$ by gravure coating, and the applied coating solution was dried to form an under coat layer.

A coating solution for a dye layer, having the following composition, was applied onto the formed under coat layer in such a way that a dried amount of application was 0.7 $g/m^2$ by gravure coatings and the applied coating solution was dried to form a dye layer to prepare a thermal transfer sheet of Example 1

Further, a coating solution for a heat resistant slipping layer, having the following composition, had been applied onto a face on the other side of the above-mentioned base in advance in such a way that a dried amount of application was 1.0 g/m$^2$ by gravure coating, and the applied coating solution had been dried to form a heat resistant slipping layer.

<Coating Solution 1 for an Under Coat Layer>

| | |
|---|---|
| colloidal silica (SNOWTEX OXS, particle diameter 4 to 6 nm, produced by Nissan Chemical Industries, Ltd., solid content 10%) | 30 parts |
| polyvinylpyrrolidone resin (K-90, produced by ISP Japan Ltd.) | 3 parts |
| water | 50 parts |
| isopropyl alcohol | 50 parts |

<Coating Solution for a Dye Layer>

| | |
|---|---|
| C.I. solvent blue 63 | 6.0 parts |
| polyvinyl butyral resin (S-LEC BX-1 produced by SEKISUI CHEMICAL CO., LTD.) | 3.0 parts |
| methyl ethyl ketone | 45.5 parts |
| toluene | 45.5 parts |

<Coating Solution for a Heat Resistant Slipping Layer>

| | |
|---|---|
| polyvinyl butyral resin (S-LEC BX-1 produced by SEKISUI CHEMICAL CO., LTD.) | 13.6 parts |
| polyisocyanate hardening agent (Takenate D218 produced by Takeda Pharmaceutical Co., Ltd.) | 0.6 parts |
| phosphate ester (PLYSURF A208S produced by DAI-ICHI KOGYO SEIYAKU CO., LTD.) | 0.8 parts |
| methyl ethyl ketone | 42.5 parts |
| toluene | 42.5 parts |

EXAMPLE 2

A thermal transfer sheet of Example 2 was prepared by following the same procedure as in Example 1 except for changing the composition of the under coat layer to the following composition in the thermal transfer sheet prepared in Example 1.

<Coating Solution 2 for an Under Coat Layer>

| | |
|---|---|
| alumina sol (Alumina Sol 200, feather form, produced by Nissan Chemical Industries, Ltd., solid content 10%) | 30 parts |
| polyvinyl alcohol resin (GOHSENOL KH-20, produced by Nippon Synthetic Chemical Industry Co., Ltd., saponification degree 80 mol %, polymerization degree 2000 to 3000) | 3 parts |
| water | 50 parts |
| isopropyl alcohol | 50 parts |

EXAMPLE 3

A thermal transfer sheet of Example 3 was prepared by following the same procedure as in Example 1 except for changing the composition of the under coat layer to the following composition in the thermal transfer sheet prepared in Example 1.

<Coating Solution 3 for an Under Coat Layer>

| | |
|---|---|
| alumina sol (Alumina Sol 200, feather form, produced by Nissan Chemical Industries, Ltd., solid content 10%) | 30 parts |
| polyvinylpyrrolidone resin (K-90, produced by ISP Japan Ltd.) | 3 parts |
| water | 50 parts |
| isopropyl alcohol | 50 parts |

EXAMPLE 4

Using a base of a PET film under the same conditions as in Example 1, a heat resistant slipping layer similar to that in Example 1 had been formed on a face on one side of this base in advance.

A coating solution 4 for an under coat layer, having the following composition, was applied onto the backside face of the face of the base on which the heat resistant slipping layer had been provided in such a way that a dried amount of application was 0.06 g/m$^2$ by gravure coating, and the applied coating solution was dried to form an under coat layer.

Furthermore, a dye layer was formed on the formed under coat layer as with Example 1 to prepare a thermal transfer sheet of Example 4.

<Coating Solution 4 for an Under Coat Layer>

| | |
|---|---|
| alumina sol (Alumina Sol 200, feather form, produced by Nissan Chemical Industries, Ltd., solid content 10%) | 6 parts |
| polyvinylpyrrolidone resin (K-90, produced by ISP Japan Ltd.) | 3 parts |
| water | 35 parts |
| isopropyl alcohol | 35 parts |

EXAMPLE 5

A thermal transfer sheet of Example 5 was prepared by following the same procedure as in Example 1 except for changing the composition of the under coat layer to the following composition in the thermal transfer sheet prepared in Example 1.

<Coating Solution 5 for an Under Coat Layer>

| | |
|---|---|
| alumina sol (Alumina Sol 200, feather form, produced by Nissan Chemical Industries, Ltd., solid content 10%) | 15 parts |
| polyvinylpyrrolidone resin (K-90, produced by ISP Japan Ltd.) | 3 parts |
| water | 40 parts |
| isopropyl alcohol | 40 parts |

EXAMPLE 6

A thermal transfer sheet of Example 6 was prepared by following the same procedure as in Example 1 except for changing the composition of the under coat layer to the following composition in the thermal transfer sheet prepared in Example 1.

<Coating Solution 6 for an Under Coat Layer>

| | |
|---|---|
| alumina sol (Alumina Sol 200, feather form, produced by Nissan Chemical Industries, Ltd., solid content 10%) | 40 parts |
| polyvinylpyrrolidone resin (K-90, produced by ISP Japan Ltd.) | 1 part |
| water | 35 parts |
| isopropyl alcohol | 35 parts |

COMPARATIVE EXAMPLE 1

Using a base of a PET film under the same conditions as in Example 1, a heat resistant slipping layer similar to that in Example 1 had been formed on a face on one side of this base in advance.

The coating solution for a dye layer used in Example 1 was applied directly onto the backside face of the face of the base on which the heat resistant slipping layer had been provided in such a way that a dried amount of application was 0.7 g/m$^2$ by gravure coating, and the applied coating solution was dried to form a dye layer to prepare a thermal transfer sheet of Comparative Example 1.

COMPARATIVE EXAMPLE 2

Using a base of a PET film under the same conditions as in Example 1, a heat resistant slipping layer similar to that in Example 1 had been formed on a face on one side of this base in advance.

A coating solution 7 for an under coat layer, having the following composition, was applied onto the backside face of the face of the base on which the heat resistant slipping layer had been provided in such a way that a dried amount of application was 0.06 g/m$^2$ by gravure coating, and the applied coating solution was dried to form an under coat layer.

Furthermore, a dye layer was formed on the formed under coat layer as with Example 1 to prepare a thermal transfer sheet of Comparative Example 2.

<Coating Solution 7 for an Under Coat Layer>

| | |
|---|---|
| polyvinylpyrrolidone resin (K-90, produced by ISP Japan Ltd.) | 10 parts |
| water | 100 parts |
| isopropyl alcohol | 100 parts |

COMPARATIVE EXAMPLE 3

Using a base of a PET film under the same conditions as in Example 1, a heat resistant slipping layer similar to that in Example 1 had been formed on a face on one side of this base in advance.

A coating solution 8 for an under coat layer, having the following composition, was applied onto the backside face of the face of the base on which the heat resistant slipping layer had been provided in such a way that a dried amount of application was 0.06 g/m$^2$ by gravure coating, and the applied coating solution was dried to form an under coat layer.

Furthermore, a dye layer was formed on the formed under coat layer as with Example 1 to prepare a thermal transfer sheet of Comparative Example 3.

<Coating Solution 8 for an Under Coat Layer>

| | |
|---|---|
| alumina sol (Alumina Sol 200, feather form, produced by Nissan Chemical Industries, Ltd., solid content 10%) | 50 parts |
| water | 25 parts |
| isopropyl alcohol | 25 parts |

TEST EXAMPLE 1

1. Reflection Density

The thermal transfer sheets of Examples 1 to 6 and Comparative Examples 1 to 3 were used in combination with a printer-specific thermal transfer image-receiving sheet for a printer P-400 manufactured by OLYMPUS Corporation to perform printing in the following conditions, and reflection densities of the maximum density (255th tone) of the resulting printed substances were measured with a MacBeth RD-918 reflective color density meter.

(Printing Conditions)

thermal head; KGT-217-12MPL20 (manufactured by KYOCERA Corporation)

average resistance of heating element; 2994 (Ω)

print density in main scanning direction; 300 dpi print density in sub scanning direction; 300 dpi applied power; 0.10 (w/dot) one line cycle; 5 (msec.)

print starting temperature; 40 (° C.)

applied pulse (tone control method); Using a test printer of multi-pulse mode which can adjust the number of divided pulses having a pulse length obtained by equally dividing the one line cycle into 256 from 0 to 250 in one line cycle, a duty ratio of each divided pulse was fixed at 70%, and the number of pulses per line cycle was separated into 15 stages between 0 and 255. Thereby, 15 stages of different energies can be provided.

2. Adhesion Strength of Dye Layer

Using the thermal transfer sheets prepared in Examples 1 to 6 and Comparative Examples 1 to 3, a cellotape (trademark) of 200 mm high by 12 mm wide was stuck on the dye layer by rubbing a tape against the dye layer two times with a thumb, and shortly thereafter, the tape was peeled off. The adhesion strength was evaluated based on the presence or absence of the adhesion of the dye layer to the tape.

Evaluations were conducted according to the following criteria.

o: There is no adhesion of the dye layer.

Δ: There is a little adhesion of the dye layer.

x: There is adhesion of the dye layer all over the cellotape.

3. Evaluation of Releasing Property After Storing

The thermal transfer sheets of Examples 1 to 6 and Comparative Examples 1 to 3 were stored for 48 hours under the circumstances in the conditions of 40° C., relative humidity 90 percents, and then using these thermal transfer sheets, printing was performed in a printing pattern in which the whole surface of the printed substance is in a solid state (tone value 255/255: maximum density) in the same printing conditions as in the measurements of the reflection density described above. It was visually investigated whether the thermal adhesion of a dye layer of a thermal transfer sheet to a thermal transfer image-receiving sheet occurs in printing or not, or whether the so-called abnormal transfer, in which the whole dye layer is transferred to the thermal transfer image-receiving sheet, arises or not.

Evaluations were conducted according to the following criteria.

o: The thermal adhesion of a dye layer to a thermal transfer image-receiving sheet does not occur and the abnormal transfer does not arise.

x: The thermal adhesion of a dye layer to a thermal transfer image-receiving sheet occurs or the abnormal transfer arises.

The measurement results of the reflection density described above and the results of evaluations of the adhesion strength of a dye layer and the releasing property after storing are shown in the following Table 1

TABLE 1

| | Composition of under coat layer (weight ratio) | Reflection density | Adhesion strength of dye layer | Evaluation of releasing property after storing |
|---|---|---|---|---|
| Example 1 | colloidal silica:PVP = 1:1 | 2.42 | ○ | ○ |
| Example 2 | alumina sol:PVA = 1:1 | 2.50 | Δ | ○ |
| Example 3 | alumina sol:PVP = 1:1 | 2.58 | ○ | ○ |
| Example 4 | alumina sol:PVP = 1:5 | 2.39 | Δ | X |
| Example 5 | alumina sol:PVP = 1:2 | 2.45 | ○ | ○ |
| Example 6 | alumina sol:PVP = 4:1 | 2.59 | ○ | ○ |
| Comparative Example 1 | — | 2.16 | X | X |
| Comparative Example 2 | polyvinylpyrrolidone resin | 2.15 | ○ | X |
| Comparative Example 3 | alumina sol | 2.56 | ○ | X |

(note)
PVP: polyvinylpyrrolidone resin

From the above-mentioned results, all of the thermal transfer sheets of Examples 1 to 6, each of which was provided with the under coat layer comprising a thermoplastic resin and colloidal inorganic pigment ultrafine particles between the base and the dye layer, had the above reflection densities of about 2.40 or more which were high concentrations. Further, the thermal transfer sheets of Examples 1 to 3, and 5 and 6 achieved good results particularly on the releasing property after storing since a ratio of the colloidal inorganic pigment ultrafine particles to the thermoplastic resin (colloidal inorganic pigment ultrafine particles/thermoplastic resin) falls within a range of 1/4 to 1/0.1, and the adhesion of the dye layer to the base was of no matter. With respect to evaluations of the releasing property after storing, the evaluation of the thermal transfer sheet of Example 4 is lower than that of other Examples but is better than that of Comparative Example 3.

The thermal transfer sheet of Comparative Example 1 is a substance in which a dye layer is provided directly on a base without having an under coat layer on the base, and this thermal transfer sheet has practical problems on the adhesion of a dye layer to a base and the releasing property from a thermal transfer image-receiving sheet of the thermal transfer sheet after storing in the conditions of high temperatures and high humidity, and this thermal transfer sheet has the reflection density of less than 2.2 and was not satisfactory as a printed substance having a high print density. The thermal transfer sheet of Comparative Example 2 is a substance in which an under coat layer comprising only a thermoplastic resin is provided between a base and a dye layer, and this thermal transfer sheet has a problem on the releasing property from a thermal transfer image-receiving sheet of the thermal transfer sheet after storing in the conditions of high temperatures and high humidity, and this thermal transfer sheet has the reflection density of less than 2.2 and was not satisfactory as a printed substance having a high print density. The thermal transfer sheet of Comparative Example 3 is a substance in which an under coat layer comprising only colloidal inorganic pigment ultrafine particles is provided between a base and a dye layer, and this thermal transfer sheet has the high reflection density of a printed substance and the excellent adhesion of a dye layer to a base, but has a problem on the releasing property from a thermal transfer image-receiving sheet of the thermal transfer sheet after storing in the conditions of high temperatures and high humidity.

EXAMPLE 7

A coating solution 9 for an under coat layer, having the following composition, was applied onto a polyethylene terephthalate (PET) film having a thickness of 4.5 μm as a base in such a way that a dried amount of application was 0.1 g/m$^2$ by gravure coating, and the applied coating solution was dried to form an under coat layer.

The coating solution for a dye layer used in Example 1 was applied onto the formed under coat layer in such a way that a dried amount of application was 0.7 g/m$^2$ by gravure coating, and the applied coating solution was dried to form a dye layer and prepare a thermal transfer sheet of Example 7.

Further, the coating solution for a heat resistant slipping layer, used in Example 1, had been applied onto a surface on the other side of the above-mentioned base in advance in such a way that a dried amount of application was 1.0 g/m$^2$ by gravure coating, and the applied coating solution had been dried to form a heat resistant slipping layer.

<Coating Solution 9 for an Under Coat Layer>

| | |
|---|---|
| alumina sol (Alumina Sol 200, produced by Nissan Chemical Industries, Ltd., solid content 10%) | 22.5 parts |
| silicate (MSH1, produced by Mitsubishi Chemical Corporation, highly reactive type, solid content 16%) | 4.7 parts |
| water | 24.3 parts |
| isopropyl alcohol | 48.5 parts |

EXAMPLE 8

A thermal transfer sheet was prepared by following the same procedure as in Example 7 except for using a coating solution 10 for an under coat layer in place of the coating solution 9 for an under coat layer to form an under coat layer.

<Coating Solution 10 for an Under Coat Layer>

| | |
|---|---|
| alumina sol (Alumina Sol 200, produced by Nissan Chemical Industries, Ltd., solid content 10%) | 28.5 parts |
| silicate (MSH1, produced by Mitsubishi Chemical Corporation, highly reactive type, solid content 16%) | 0.9 parts |
| water | 22.1 parts |
| isopropyl alcohol | 48.5 parts |

EXAMPLE 9

A thermal transfer sheet was prepared by following the same procedure as in Example 7 except for using a coating solution 11 for an under coat layer in place of the coating solution 9 for an under coat layer to form an under coat layer.

<Coating Solution 11 for an Under Coat Layer>

| | |
|---|---|
| alumina sol (Alumina Sol 200, produced by Nissan Chemical Industries, Ltd., solid content 10%) | 7.5 parts |
| silicate (MSH1, produced by Mitsubishi Chemical Corporation, highly reactive type, solid content 16%) | 14.1 parts |
| water | 29.9 parts |
| isopropyl alcohol | 48.5 parts |

EXAMPLE 10

A thermal transfer sheet was prepared by following the same procedure as in Example 7 except for using a coating solution 12 for an under coat layer in place of the coating solution 9 for an under coat layer to form an under coat layer.

<Coating Solution 12 for an Under Coat Layer>

| | |
|---|---|
| alumina sol (Alumina Sol 200, produced by Nissan Chemical Industries, Ltd., solid content 10%) | 15 parts |
| silicate (MSH1, produced by Mitsubishi Chemical Corporation, highly reactive type, solid content 16%) | 9.4 parts |
| water | 27.1 parts |
| isopropyl alcohol | 48.5 parts |

COMPARATIVE EXAMPLE 4

A thermal transfer sheet was prepared by following the same procedure as in Example 7 except for using a coating solution 13 for an under coat layer in place of the coating solution 9 for an under coat layer to form an under coat layer.

<Coating Solution 13 for an Under Coat Layer>

| | |
|---|---|
| alumina sol (Alumina Sol 200, produced by Nissan Chemical Industries, Ltd., solid content 10%) | 30 parts |
| water | 21.5 parts |
| isopropyl alcohol | 48.5 parts |

COMPARATIVE EXAMPLE 5

A thermal transfer sheet was prepared by following the same procedure as in Example 7 except for using a coating solution 14 for an under coat layer in place of the coating solution 9 for an under coat layer to form an under coat layer.

<Coating Solution 14 for an Under Coat Layer>

| | |
|---|---|
| polyvinylpyrrolidone resin (K-90, produced by ISP Japan Ltd.) | 3 parts |
| water | 48.5 parts |
| isopropyl alcohol | 48.5 parts |

EXAMPLE 11

A thermal transfer sheet was prepared by following the same procedure as in Example 7 except for using a coating solution 15 for an under coat layer in place of the coating solution 9 for an under coat layer to form an under coat layer.

<Coating Solution 15 for an Under Coat Layer>

| | |
|---|---|
| alumina sol (Alumina Sol 200, produced by Nissan Chemical Industries, Ltd., solid content 10%) | 15 parts |
| polyvinylpyrrolidone resin (K-90, produced by ISP Japan Ltd.) | 1.5 parts |
| water | 35 parts |
| isopropyl alcohol | 48.5 parts |

TEST EXAMPLE 2

Tests of the reflection density, the adhesion strength of the dye layer and evaluations of the releasing property after storing were conducted by following the same procedures as in Test Example 1 except for changing the evaluation criteria in evaluations of the releasing property after storing to the following criteria, and the thermal transfer sheets obtained in Examples 7 to 11 and Comparative Examples 1, 4 and 5 were evaluated.

(Evaluation Criteria)

The results of the above-mentioned measurements are shown in Table 2.

TABLE 2

| | Composition of under coat layer (weight ratio) | Adhesion strength of dye layer | | Evaluation of releasing property after storing | Reflection density |
|---|---|---|---|---|---|
| | | Before storing | After storing | | |
| Example 7 | alumina sol:silicate = 3:1 | ○ | ○ | ○ | 2.50 |
| Example 8 | alumina sol:silicate = 19:1 | ○ | ○ | ○ | 2.48 |
| Example 9 | alumina sol:silicate = 1:3 | ○ | X | ○ | 2.33 |
| Example 10 | alumina sol:silicate = 1:1 | ○ | X | ○ | 2.25 |
| Example 11 | alumina sol:PVP = 1:1 | ○ | Δ | ○ | 2.58 |
| Comparative Example 1 | — | X | X | X | 2.16 |
| Comparative Example 4 | alumina sol | ○ | Δ | Δ | 2.53 |
| Comparative Example 5 | PVP | ○ | Δ | Δ | 2.01 |

(note)
PVP: polyvinylpyrrolidone resin
○: The abnormal transfer does not arise.
Δ: The abnormal transfer arises slightly.
X : The abnormal transfer of the whole print surface occurs.

From the results of measurements, it was evident that all of the thermal transfer sheets of Examples 7 to 11 are superior in the releasing property and the reflection density. Particularly, it was found that the thermal transfer sheets of Examples 7 and 8 in which silicate was mixed in an amount 0.1 to 50 parts by weight with respect to 100 parts by weight of alumina sol (colloidal inorganic pigment ultrafine particles) have improved releasing property after storing and reflection density. Further, it was found that the thermal transfer sheet of Comparative Example 4, in which silicate was not mixed in the under coat layer, and the thermal transfer sheet of Comparative Example 5, in which only polyvinylpyrrolidone resin was mixed in the under coat layer, were inferior in the adhesion strength and the releasing property after storing, respectively, to the thermal transfer sheets of Examples 7 and 8. It was found that the thermal transfer sheets of Examples 7 and 8 were further superior in the adhesion strength after storing to that of Example 11 in which the alumina sol and the polyvinylpyrrolidone resin were mixed in the under coat layer. In addition, it was found that the thermal transfer sheet of Comparative Example 1 not having the under coat layer was low in all of the adhesion strength, the releasing property and the reflection density.

EXAMPLE 12

A coating solution 16 for an under coat layer, having the following composition, was applied onto a polyethylene terephthalate (PET) film having a thickness of 4.5 μm as a base in such a way that a dried amount of application was 0.18 to 0.22 g/m$^2$ by gravure coating, and the applied coating solution was dried to form an under coat layer.

The coating solution for a dye layer used in Example 1 was applied onto the formed under coat layer in such a way that a dried amount of application was 0.7 g/m$^2$ by gravure coating, and the applied coating solution was dried to form a dye layer to prepare a thermal transfer sheet of Example 12.

Further, the coating solution for a heat resistant slipping layer, used in Example 1, had been applied onto a face on the other side of the above-mentioned base in advance in such a way that a dried amount of application was 1.0 g/m$^2$ by gravure coating, and the applied coating solution had been dried to form a heat resistant slipping layer.

<Coating Solution 16 for an Under Coat Layer>

| | |
|---|---|
| alumina sol (Alumina Sol 200, produced by Nissan Chemical Industries, Ltd., solid content 10%) | 39.960 parts |
| aluminum alcoholate (aluminum sec-butylate (ASBD), produced by Kawaken Fine Chemicals Co., Ltd.) | 0.004 parts |
| water | 12.036 parts |
| isopropyl alcohol | 48.000 parts |

EXAMPLES 13 TO 17

Thermal transfer sheets were prepared by following the same procedure as in Example 12 except for using coating solutions 17 to 21 for an under coat layer shown in Table 3 in place of the coating solution 16 for an under coat layer to form an under coat layer.

EXAMPLE 18

A thermal transfer sheet was prepared by following the same procedure as in Example 12 except for using the following coating solution 22 for an under coat layer in place of the coating solution 16 for an under coat layer to form an under coat layer.

<Coating Solution 22 for an Under Coat Layer>

| | |
|---|---|
| alumina sol (alumina Sol 200, produced by Nissan Chemical Industries, Ltd., solid content 10%) | 38.000 parts |
| aluminum alcoholate (aluminum isopropylate mono-sec-butylate (AMD), produced by Kawaken Fine Chemicals Co., Ltd.) | 0.200 parts |
| water | 13.800 parts |
| isopropyl alcohol | 48.000 parts |

COMPARATIVE EXAMPLE 6

A thermal transfer sheet was prepared by following the same procedure as in Example 12 except for using a coating solution 23 for an under coat layer in place of the coating solution 16 for an under coat layer to form an under coat layer.

<Coating Solution 23 for an Under Coat Layer>

| | |
|---|---|
| alumina sol (Alumina Sol 200, produced by Nissan Chemical Industries, Ltd., solid content 10%) | 40 parts |
| water | 12 parts |
| isopropyl alcohol | 48 parts |

COMPARATIVE EXAMPLE 7

A thermal transfer sheet was prepared by following the same procedure as in Example 12 except for using a coating solution 24 for an under coat layer in place of the coating solution 16 for an under coat layer to form an under coat layer.

<Coating Solution 24 for an Under Coat Layer> aluminum alcoholate (aluminum sec-butylate (ASBD), produced by Kawaken Fine Chemicals Co., Ltd.) 4 parts isopropyl alcohol 96 parts

TABLE 3

| | Composition of under coat layer (weight ratio) | Alumina sol | Aluminum alcoholate | Water | IPA |
|---|---|---|---|---|---|
| Example 12 | Alumina sol:Aluminum alcoholate (ASBD) = 99.9:0.1 | 39.960 | 0.004 | 12.036 | 48.000 |
| Example 13 | Alumina sol:Aluminum alcoholate (ASBD) = 99.5:0.5 | 39.800 | 0.020 | 12.180 | 48.000 |
| Example 14 | Alumina sol:Aluminum alcoholate (ASBD) = 99:1 | 39.600 | 0.040 | 12.360 | 48.000 |
| Example 15 | Alumina sol:Aluminum alcoholate (ASBD) = 95:5 | 38.000 | 0.200 | 13.800 | 48.000 |
| Example 16 | Alumina sol:Aluminum alcoholate (ASBD) = 90:10 | 36.000 | 0.400 | 15.600 | 48.000 |
| Example 17 | Alumina sol:Aluminum alcoholate (ASBD) = 50:50 | 20.000 | 2.000 | 30.000 | 48.000 |
| Example 18 | Alumina sol:Aluminum alcoholate (AMD) = 95:5 | 38.000 | 0.200 | 13.800 | 48.000 |
| Comparative Example 6 | Alumina sol | 40.000 | 0 | 12.000 | 48.000 |
| Camparative Example 7 | Aluminum alcoholate (ASBD) | 0 | 4.000 | 0 | 96.000 |

ASBD: aluminum sec-butylate,

AMD: aluminum isopropylate mono-sec-butylate

TEST EXAMPLE 3

The thermal transfer sheets obtained in Examples 12 to 17 and Comparative Examples 1, and 5 to 7 were evaluated according to the following methods.

1. Reflection Density, 2. Adhesion Strength of Dye Layer

The reflection density and the adhesion strength of the dye layer were measured in the same way as in Test Example 1. Further, the test of the adhesion strength of dye layer was also conducted on thermal transfer sheets after being stored for 100 hours under the circumstances in the conditions of 40° C., relative humidity 90 percents.

3. Evaluation of Releasing Property After Storing

The thermal transfer sheets were stored for 100 hours under the circumstances in the conditions of 40° C., relative humidity 90 percents, and then using these thermal transfer sheets, printing was performed in a printing pattern in which the whole surface of the printed substance is in a solid state (tone value 255/255: maximum density) in the same printing conditions as in the measurements of the reflection density described above. It was visually investigated whether the thermal adhesion of a dye layer of a thermal transfer sheet to a thermal transfer image-receiving sheet occurs or not, or whether the so-called abnormal transfer, in which the whole dye layer is transferred to the thermal transfer image-receiving sheet, arises or not to evaluate the thermal transfer sheets according to the following criteria.

(Evaluation Criteria)

o: The abnormal transfer does not arise.

Δ: The abnormal transfer arises slightly.

x: The abnormal transfer of the whole print surface occurs.

The results of the above-mentioned measurements are shown in Table 4.ticles. Particularly, the thermal transfer sheets (2) and (3) of the present invention have high adhesion strength of a dye

TABLE 4

| | Composition of under coat layer (weight ratio) | Adhesion strength of dye layer | | Evaluation of releasing property | |
|---|---|---|---|---|---|
| | | Before storing | After storing | after storing | Reflection density |
| Example 12 | Alumina sol:Aluminum alcoholate (ASBD) = 99.9:0.1 | ○ | Δ | ○ | 2.65 |
| Example 13 | Alumina sol:Aluminum alcoholate (ASBD) = 99.5:0.5 | ○ | Δ | ○ | 2.58 |
| Example 14 | Alumina sol:Aluminum alcohalate (ASBD) = 99:1 | ○ | ○ | ○ | 2.63 |
| Example 15 | Alumina sol:Aluminum alcoholate (ASBD) = 95:5 | ○ | ○ | ○ | 2.66 |
| Example 16 | Alumina sol:Aluminum alcoholate (ASBD) = 90:10 | ○ | ○ | ○ | 2.65 |
| Example 17 | Alumina sol:Aluminum alcoholate (ASBD) = 50:50 | ○ | Δ | ○ | 2.65 |
| Example 18 | Alumina sol:Aluminum alcoholate (AMD) = 95:5 | ○ | ○ | ○ | 2.64 |
| Comparative Example 1 | — | X | X | X | 1.86 |
| Comparative Example 5 | polyvinylpyrrolidone resin | Δ | X | X | 2.11 |
| Comparative Example 6 | Alumina sol | ○ | Δ | Δ | 2.69 |
| Comparative Example 7 | Aluminum alcoholate (ASBD) | ○ | Δ | ○ | 2.10 |

From the results of measurements, it was evident that all of the thermal transfer sheets of Examples 12 to 17 are superior in the adhesion strength and the reflection density, and has the good releasing property even after storing. Particularly, it was found that the thermal transfer sheets of Examples 14 to 16, and 18, in which alumina sol: aluminum alcoholate=99:1 to 90:10 and aluminum alcoholate was mixed in an amount 0.1 to 50 parts by weight with respect to 100 parts by weight of the total of the foregoing colloidal inorganic pigment ultrafine particles and the foregoing aluminum alcoholate, can retain the adhesion strength of the dye layer even after storing. On the other hand, the thermal transfer sheets of Comparative Examples 1 and 5 did not achieve good results in any test, and the thermal transfer sheet of Comparative Example 6 was particularly low in the evaluation of a releasing property, and the thermal transfer sheet of Comparative Example 7 was particularly low in the reflection density.

INDUSTRIAL APPLICABILITY

Since the thermal transfer sheet of the present invention has the above-mentioned constitution, it prevents the dye from transferring from the dye layer to the under coat layer in printing and performs the dye diffusion to the receiving layer side of the image-receiving sheet effectively, and thereby transfer sensitivity in printing is high and a print density can be enhanced. Further, in the thermal transfer sheet of the present invention, a releasing property from a image-receiving sheet in printing after being stored in the conditions of high temperatures and high humidity is hardly deteriorated compared with the case where the under coat layer is composed of only the colloidal inorganic pigment ultrafine parlayer to a base even after being stored in the conditions of high temperatures and high humidity.

DESCRIPTION OF SYMBOLS

1 base

2 under coat layer

3 dye layer

4 heat resistant slipping layer

Figure 1:
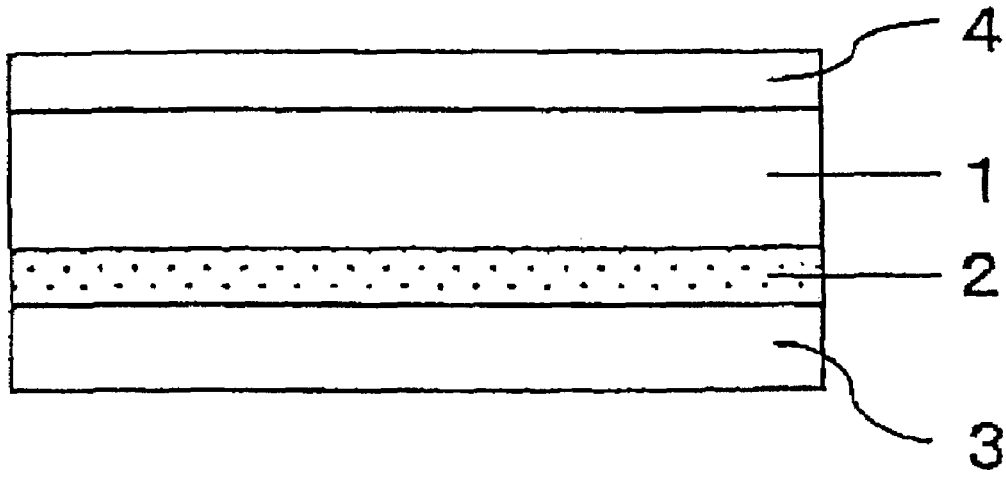
FIG. 1 is a schematic sectional view showing the best embodiment which is a thermal transfer sheet (1) of the present invention.

The invention claimed is:

1. A thermal transfer sheet, wherein an under coat layer containing a thermoplastic resin and alumina sol and a dye layer are formed in order on a face on one side of a base and wherein a mixing ratio by weight between the alumina sol and the thermoplastic resin is 1/4 to 1/0.1.

2. The thermal transfer sheet according to claim 1, wherein the thermoplastic resin is a polyvinylpyrrolidone resin or a polyvinyl alcohol resin.

3. The thermal transfer sheet according to claim 1, wherein a heat resistant slipping layer is provided on a face of the backside of the side of a base on which the under coat layer is provided.

4. A thermal transfer sheet, wherein an under coat layer formed by using colloidal inorganic pigment ultrafine particles and silicate and a dye layer are formed in order on a face on one side of a base and wherein an amount of the silicate is 0.1 to 50 parts by weight with respect to 100 parts by weight of the colloidal inorganic pigment ultrafine particle, and wherein the colloidal inorganic pigment ultrafine particle is alumina sol.

5. The thermal transfer sheet according to claim 4, wherein said silicate is alkoxide of silicon, or an oligomer having a siloxane skeleton which is obtained by hydrolysis condensation of alkoxide of silicon.

6. The thermal transfer sheet according to claim 5, wherein a heat resistant slipping layer is provided on a face of the backside of the side of a base on which the under coat layer is provided.

7. The thermal transfer sheet according to claim 4, wherein a heat resistant slipping layer is further provided on a face of the backside of the side of the base on which the under coat layer is provided.

8. A thermal transfer sheet, wherein an under coat layer is formed by using colloidal inorganic pigment ultrafine particles and aluminum alcoholate and a dye layer are formed in order on a face on one side of a base.

9. The thermal transfer sheet according to claim 8, wherein an amount of the aluminum alcoholate is 0.1 to 50 parts by weight with respect to 100 parts by weight of the total of the colloidal inorganic pigment ultrafine particle and said aluminum alcoholate.

10. The thermal transfer sheet according to claim 8, wherein a heat resistant slipping layer is provided on a face of the backside of the side of a base on which the under coat layer is provided.

11. The thermal transfer sheet according to claim 8, wherein the colloidal inorganic pigment ultrafine particle is alumina sol.

* * * * *